United States Patent [19]

Campau

[11] Patent Number: 5,048,557

[45] Date of Patent: Sep. 17, 1991

[54] MAIN VALVE AND SEAT FOR USE IN FILLING CONTAINERS TO A PREDETERMINED LEVEL

[75] Inventor: Daniel N. Campau, Grand Rapids, Mich.

[73] Assignee: Flow-Rite Controls, Ltd., Grand Rapids, Mich.

[21] Appl. No.: 554,293

[22] Filed: Jul. 17, 1990

[51] Int. Cl.[5] ..... F16K 31/126; F16K 21/18

[52] U.S. Cl. ..... 137/386; 137/393; 137/414; 137/805; 141/198

[58] Field of Search ..... 137/386, 393, 414, 805, 137/260, 261; 73/290 R; 141/198

[56] References Cited

U.S. PATENT DOCUMENTS

| | | | |
|---|---|---|---|
| 3,144,874 | 8/1964 | Goldtrap | 137/414 |
| 4,211,249 | 7/1980 | Richards | 137/393 |
| 4,258,746 | 3/1981 | Hudson | 137/414 |
| 4,296,996 | 10/1981 | Pataki et al. | 137/393 |
| 4,299,248 | 11/1981 | Becker et al. | 137/414 |
| 4,341,238 | 7/1982 | Roosa et al. | 137/414 |
| 4,515,178 | 5/1985 | Campau | 137/393 |
| 4,527,593 | 7/1985 | Campau | 137/393 |
| 4,790,349 | 12/1988 | Harris | 137/393 |
| 4,945,944 | 8/1990 | Chen | 137/414 |

*Primary Examiner*—George L. Walton

*Attorney, Agent, or Firm*—Niro, Scavone, Haller & Niro

[57] ABSTRACT

An improved apparatus used in a system for filling containers with a required liquid to a predetermined level are disclosed. The apparatus includes an improved main valve means for controlling the flow of liquid through the apparatus and into the container. This improved main valve means includes an improved main valve, an improved main valve seat, and a main valve support.

10 Claims, 1 Drawing Sheet

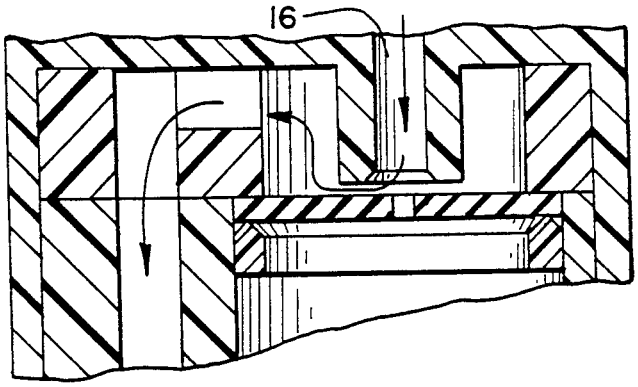
FIG. 1
PRIOR ART
FIG. 5
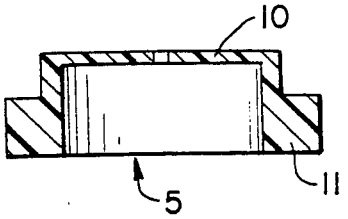
FIG. 2
PRIOR ART
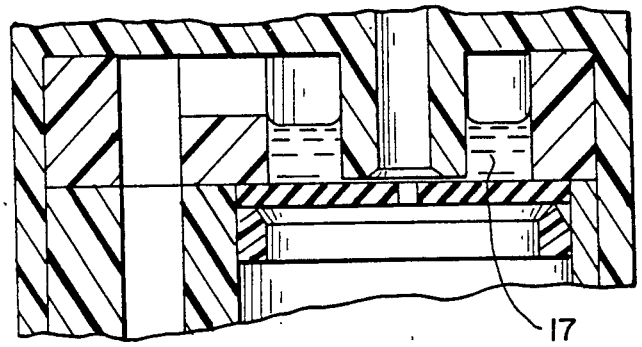
FIG. 6
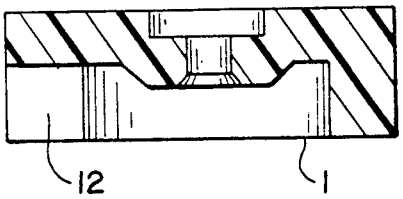
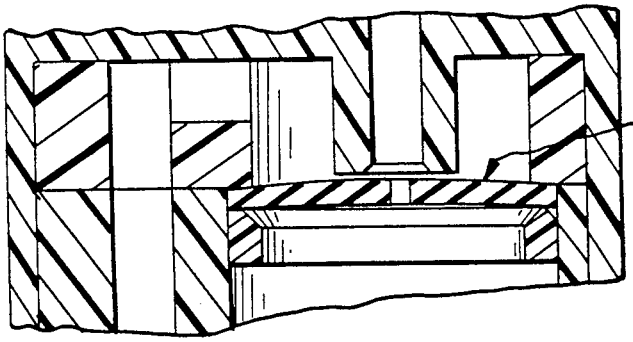
FIG. 3
PRIOR ART
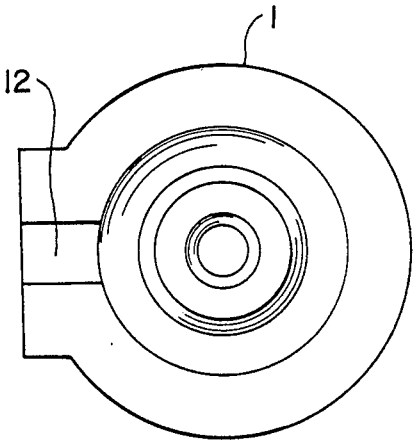
FIG. 7
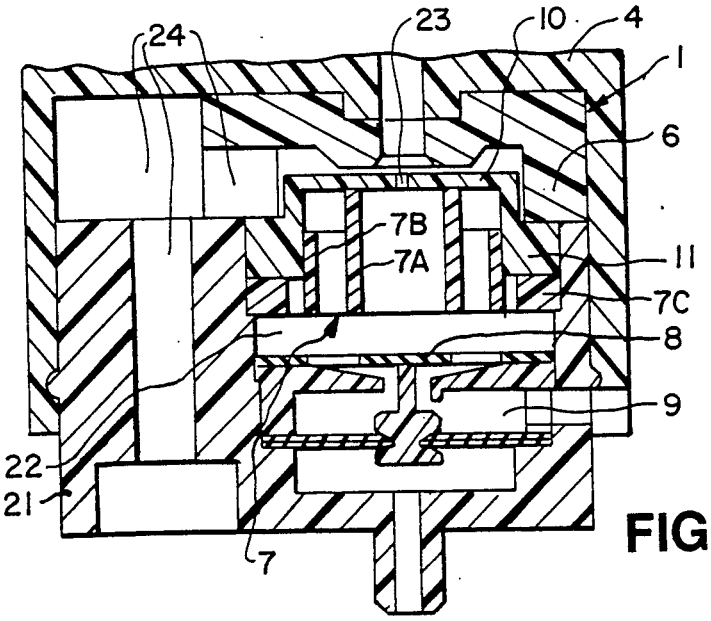
FIG. 4

MAIN VALVE AND SEAT FOR USE IN FILLING CONTAINERS TO A PREDETERMINED LEVEL

BACKGROUND OF THE INVENTION

The present invention relates generally to an apparatus and a system for filling containers with a liquid and, more particularly, to an improved design and construction for the main valve means which controls the flow of liquid through the apparatus and into the container. The invention utilizes fluidic controls which require only the static and dynamic energy of the liquid medium as a power source. The invention finds advantageous application in automated systems for simultaneously filling a number of separate containers from a single supply, and is designed to overcome some design and productions problems which were encountered in the apparatus and system disclosed in U.S. Pat. No. 4,527,593, which is hereby incorporated by reference.

More particularly, an embodiment of U.S. Pat. No. 4,527,593 (hereinafter the "'593 patent") locates the main valve and main valve seat seat in a "trap area" which retains water after a fill cycle. In certain applications, evaporation of the fluid used to to fill the containers leaves a sticky residue in the annular space between the main valve and its seat. This residue can glue the main valve and its seat together, resulting in premature shut-off (i.e., a failure to fill the container) on the next fill cycle.

Another disadvantage of the invention disclosed by the '593 patent also involves a premature shut-off situation. A sudden burst of fluid pressure, such as occurs when the fluid supply turns on, can cause the flexible main valve to deflect toward the flapper, pushing the main valve away from its seat. This causes an accompanying fluid displacement between the valve and the flapper which allows the flapper to close prematurely. This fluid displacement causes the fluid to push out the air in the connecting tubing through the refill valves before the fluid reaches the valves. As the Fluidic Level Sensor (the fluid amplifier in conjunction with the pilot valve) of the '593 patent does not operate until liquid is flowing through it, the refill valves must remain open, bleeding off the air, until fluid begins flowing through the sensors. In other words, the refill valves must be able to pass the air caused by a sudden burst of fluid pressure without shutting off.

Production problems have also been found with the invention disclosed by the '593 patent. A clamp-up stress is needed on the main valve to seal it, but such a stress can cause the main valve to distort and bulge. The amount of bulge is affected, concomitantly, by the tolerance on the valve thickness. This main valve bulge can reduce the gap between the main valve and its seat, aggravating the above-mentioned sticking problem, and decreasing the ability of the system to operate under high pressure rise rates. Additionally, the clamp-up force exerted on the main valve of the '593 patent is tenuous. If the force is too high, the valve will bulge; if too low, the valve will be improperly sealed and leak, or blow out under full system pressure.

Finally, the valve cap of the '593 patent is a relatively complex, injection-molded plastic part. This method of manufacture can result in varying thicknesses of the cap which leads to sinks in some surfaces. This condition makes it difficult to control the height of the valve seat boss. Consequently, the gap between the main valve and its seat can vary.

SUMMARY OF THE INVENTION

The apparatus of the present invention is extremely simple in design and construction and can be effectively used to fill a container with a liquid to a predetermined level. Moreover, the present invention is designed to be an improvement over, and to solve certain problems associated with, the invention disclosed by the '593 patent.

One object, therefore, of the present invention is to reduce the chance of sticky residues in the fluid collecting in the main valve seat area.

A second object of the present invention is to more tightly control the dimensions of the main valve seat and thus eliminate the problem of sinks in the cap causing the height of the main valve seat boss to vary.

A third object of the present invention is to design the main valve to withstand the necessary clamp-up stresses required for sealing, without allowing the main valve to bulge.

A fourth object of the present invention is to solve the problems associated with a premature shut-off of the system due to a sudden burst of fluid supply pressure, caused by the failure of the refill valves to pass air (forced out by the pressure burst) without shutting off.

A fifth object of the present invention is to accomplish the above four objectives while maintaining the simplicity in design and construction achieved in the invention disclosed by the '593 patent.

These objectives are achieved through a redesign of the main valve and main valve seat, and a new method of manufacture of the main valve seat boss.

BRIEF DESCRIPTION OF THE DRAWINGS

The novel features of the invention are set forth in the appended claims. The invention itself, however, together with further objects and attendant advantages thereof, will be best understood by reference to the following description taken in connection with the accompanying drawings in which:

FIG. 1 is a cross-sectional view of the main valve and attendant parts disclosed in the '593 patent.

FIG. 2 is a cross-sectional view of the same valve shown in FIG. 1, illustrating a collection of residue which can cause the main valve to stick to its seat.

FIG. 3 is a cross-sectional view of the same valve shown in FIG. 1, illustrating the bulge effect of the main valve caused by clamp-up stress.

FIG. 4 is a cross-sectional view of the main valve and attendant parts which are the subject of the present invention.

FIG. 5 is a side view of the main valve of the present invention.

FIGS. 6 and 7 are cross-sectional and plan views, respectively, of the main valve seat of the present invention.

DETAILED DESCRIPTION OF THE PREFERRED EMBODIMENT

Referring to the drawings, and particularly FIG. 4, the main valve 5 and attendant parts are illustrated. Fluid flows through tap line 16 from a filling means (described in the '593 patent). With the main valve seat 1 constructed as shown, fluid will drain away from the valve seat 1 along passageway 24 and thus reduce the chance of sticky residues 17 (shown in FIG. 2) from the fluid collecting in the seat area and causing the main valve to stick to the seat. The trap area 2 of FIG. 1 is thus eliminated.

Main valve seat 1 is now molded as a separate component; it then press fits onto the boss 3 of upper housing 4. This enables the main valve seat 1 to be manufactured to more precise dimensional tolerances, eliminating sinks in the upper housing 4 which cause the height of the boss 3 to vary. Additionally, this ability to more tightly control the dimensions of the valve seat enables a greater control over the gap distance between valve seat boss 3 and main valve 5. This enhanced control over the gap distance further reduces the opportunity for sticky residues to collect in the seat area and cause the main valve to adhere to the seat. Finally, the shoulder 6 of main valve seat 1 is assured a constant depth, thus further controlling the gap between the main valve and its seat, as well as assuring adequate retention of the main valve without distortion of that valve.

Referring still to FIG. 4, upper housing 4 and lower housing 21 communicate in a press fit relationship. Additionally, a main valve support designated generally as 7 has been added. Thus main valve support 7*a* lends vertical strength to the raised valve area 10 of main valve 5, and main valve support 7C lends vertical strength to the heavy-walled clamp-up area 11 of main valve 5. These supports prevent the main valve from deflecting toward flapper 8 when a sudden burst of supply pressure occurs. If this deflection is not prevented, the sudden burst of pressure pushes the main valve away from the main valve seat 1 and displaces the volume of fluid between the main valve 5 and flapper 8 (the fluid contained within the main valve support 7 and spacer means 22). This causes flapper 8 to close prematurely, before the Fluidic Level Sensor has time to develop a pressure signal to hold flapper 8 open. By preventing the main valve from deflecting away from its seat, the main valve support 7 restricts flow into pilot chamber 9 to that flow occuring through main valve orifice 23. To use an analogy for explanatory purposes only, the main valve support 7, main valve orifice 23 and the fluid volume in pilot chamber 9 can be likened to an electrical RC time delay: their interaction gives the Fluidic Level Sensor time to develop a "hold open" signal before the pilot chamber pressure rises to a shut-off level.

The main valve support 7 also lends horizontal strength to the main valve 5. Thus, main valve support 7B, which is connected to support 7A by rigid means, allows the main valve to withstand the clamp-up stresses, necessary for a tight sealing of the valve without leakage, without distortion or bulge of the valve (shown in FIG. 3 of the prior art) in the sealing area. The main valve support members 7A, 7B and 7C of main valve support 7, which can consist of concentric cylinders or other means, are interconnected along the uppermost portion of spacer means 22.

Referring now to FIG. 5, a side view of the improved main valve 5 is shown, with raised valve area 10 and heavy walled clamp-up area 11. The heavy walled clamp-up area 11 prevents clamp-up stresses acting in the heavy walled area from distorting the main valve. Thus, the gap dimension between the main valve and its seat is prevented from reduction, and the main valve support 7 is prevented from distortion.

Referring finally to FIGS. 6 and 7, a cross-sectional view of main valve seat 1, and a planar view of main valve seat 1 and main valve support 7 are shown, respectively. The notch 12 of passageway 24 in the valve seat allows fluid to drain. Also, the thickened sidewall 5 in main valve 1 bridges notch 12 without allowing significant deflection or distortion of the main valve.

What is claimed is:

1. A valve apparatus for filling a container to a predetermined level with liquid provided by supply means connected to the container through said valve apparatus, in which said valve apparatus is normally open and closes only upon the application of supply liquid pressure together with the filling of said container to said predetermined level, said apparatus, comprising:

an upper housing, a lower housing, and a main valve means contained within said upper and lower housings for controlling the supply of liquid to the container, said main valve means including a flexible main valve, a main valve seat, and a main valve support for supporting said flexible main valve to prevent substantial deflection of said main valve away from said seat when liquid pressure from said supply means is applied to said valve apparatus, said main valve being maintained a predetermined distance from said seat when liquid pressure from said supply means is released from said valve apparatus, a portion of said main valve support being disposed within said main valve for engaging the interior periphery of said main valve and for limiting the amount of deflection of said main valve in a direction away from said main valve seat, a lower portion of said valve support extending exteriorally of said main valve to provide a substantially circumferential support about a lower external periphery of said main valve for limiting peripheral deflection of said main valve.

2. The valve apparatus of claim 1 for filling a container to a predetermined level, wherein said flexible main valve is an integrally molded, unitary element including a raised seat-engaging area and sidewalls carrying said raised area, said main valve being mounted in a press fit relationship with said main valve seat.

3. The valve apparatus of claim 2 for filling a container to a predetermined level, wherein said main valve support includes both means for supporting the raised seat-engaging area and the sidewalls of said main valve in the vertical direction, and means for supporting the sidewalls of said main valve in the horizontal direction.

4. The valve apparatus of claim 3 for filling a container to a predetermined level, wherein said main valve supporting means includes lower, upper and intermediate members, each of which is generally vertical and rigid, said upper member extending to abut the underside of said raised seat-engaging area of said main valve, said intermediate member extending to engage the inside of said sidewalls of said main valve, and said lower member extending to abut the underside of said sidewalls.

5. The valve apparatus of claim 3 for filling a container to a predetermined level, wherein said main valve supporting means includes three rigidly interconnected concentric cylinders each having a different length, the longest cylinder abutting the underside of said raised seat-engaging area of said main valve, the intermediate length cylinder abutting the inside of said sidewalls of said main valve, and the shortest cylinder abutting the underside of said sidewalls of said main valve.

6. The valve apparatus of claim 1 for filling a container to a predetermined level, further comprising a passageway in fluid communication with said flexible main valve and said main valve seat, said passageway being oriented to permit the flow of residual liquid to flow away from said valve seat after said main valve has been placed in a closed position, and said deflection of said main valve being prevented during the time period following the onset of liquid pressure from said supply means.

7. The valve apparatus of claim 6 for filling a container with a liquid to a predetermined level, further comprising a drain in fluid communication with said passageway to allow the flow of liquid from said passageway into the container, wherein said main valve seat is disposed above said main valve, and said passageway is disposed above said drain.

8. The valve apparatus of claim 6 for filling a container to a predetermined level, wherein said main valve, said main valve seat and said passageway are oriented to permit residual liquid to flow through said passageway solely under the influence of gravity.

9. The valve apparatus of claim 6 for filling a container with a liquid to a predetermined level, wherein said main valve seat is disposed above said main valve.

10. The valve apparatus of claim 1 for filling a container to a predetermined level, further comprising:

fluid amplifier means for receiving at least a portion of the liquid flowing through said main valve means and thereby generating a pressure signal only until the liquid within said container reaches said predetermined level;

and pilot valve means for maintaining the main valve means open in the presence of said pressure signal and for closing said main valve means in the absence of said pressure signal.

* * * * *